US007227131B2

(12) United States Patent
Yamaguchi et al.

(10) Patent No.: US 7,227,131 B2
(45) Date of Patent: Jun. 5, 2007

(54) TIME OF FLIGHT MASS SPECTROMETER

(75) Inventors: Shinichi Yamaguchi, Kyouto-fu (JP); Morio Ishihara, Osaka-fu (JP); Michisato Toyoda, Osaka-fu (JP); Daisuke Okumura, Osaka-fu (JP)

(73) Assignees: Shimadzu Corporation, Kyoto (JP); Osaka University, Osaka (JP)

( * ) Notice: Subject to any disclaimer, the term of this patent is extended or adjusted under 35 U.S.C. 154(b) by 219 days.

(21) Appl. No.: 10/929,768

(22) Filed: Aug. 31, 2004

(65) Prior Publication Data

US 2005/0194528 A1 Sep. 8, 2005

(30) Foreign Application Priority Data

Sep. 2, 2003 (JP) ..... 2003-309553

(51) Int. Cl.
*H01J 49/40* (2006.01)

(52) U.S. Cl. ..... 250/287

(58) Field of Classification Search ..... None
See application file for complete search history.

(56) References Cited

U.S. PATENT DOCUMENTS 6,469,295 B1 * 10/2002 Park ..... 250/282
6,906,321 B2 * 6/2005 Yamaguchi ..... 250/287
6,949,736 B2 * 9/2005 Ishihara ..... 250/282
6,949,738 B2 * 9/2005 Yamaguchi et al. ..... 250/287
7,091,480 B2 * 8/2006 Yamaguchi et al. ..... 250/287
7,148,473 B2 * 12/2006 Yamaguchi et al. ..... 250/287
2006/0192110 A1 * 8/2006 Yamaguchi ..... 250/288

FOREIGN PATENT DOCUMENTS

JP 11-135060 5/1999
JP 11-297267 10/1999

* cited by examiner

*Primary Examiner*—Jack I. Berman
(74) *Attorney, Agent, or Firm*—Westerman, Hattori, Daniels & Adrian, LLP.

(57) ABSTRACT

A time of flight type mass spectrometer (TOF-MS) of the present invention includes: a flight space containing a loop orbit on which ions fly once or more than once; a flight controller for making ions of a same mass to charge ratio fly the loop orbit at several values of number of turns; a flight time measurer for measuring a length of flight time of the ions; and a processor for determining the mass to charge ratio of the ions based on a relationship between the value of number of turns and the length of flight time of the ions. The speed of ions flying a loop orbit depends on their mass to charge ratios. For ions of the same mass to charge ratio, the difference between the lengths of flight time of the ions flying the loop orbit N turns and of the ions flying the loop orbit N+1 turns depends on the speed of the ions, so that the difference depends on the mass to charge ratio of the ions. The difference in the length of flight time is unrelated to the variation in the starting time (jitter), variation in the detection timing (jitter), etc, so that the value of the mass to charge ratio can be precisely determined free from errors caused by such disturbing factors.

5 Claims, 2 Drawing Sheets

TIME OF FLIGHT MASS SPECTROMETER

The present invention relates to a time of flight mass spectrometer (TOF-MS), and especially to one in which ions repeatedly fly a loop orbit or a reciprocal path.

BACKGROUND OF THE INVENTION

In a TOF-MS, ions accelerated by an electric field are injected into a flight space where no electric field or magnetic field is present. The ions are separated by their mass to charge ratios according to the time of flight until they reach and are detected by a detector. Since the difference of the lengths of flight time of two ions having different mass to charge ratios is larger as the flight path is longer, it is preferable to design the flight path as long as possible in order to enhance the resolution of the mass to charge ratio of a TOF-MS. In many cases, however, it is difficult to incorporate a long straight path in a TOF-MS due to the limited overall size, so that various measures have been taken to effectively lengthen the flight length.

In the Japanese Unexamined Patent Publication No. H11-297267, an elliptic orbit is formed using plural toroidal type sector-formed electric fields, and the ions are guided to fly repeatedly on the elliptic orbit many times, whereby the effective flight length is elongated. In the Japanese Unexamined Patent Publication No. H11-135060, ions fly an "8" shaped orbit repeatedly. In these TOF-MSs, the length of flight time of ions from the time when they start the ion source and to the time when they arrive at and are detected by the ion detector is measured, where the ions fly the closed orbit a predetermined times between the ion source and the ion detector. The mass to charge ratios of the ions are calculated based on the lengths of the flight time. As the number of turns the ions fly the orbit is larger, the length of flight time is longer, so that the resolution of the mass to charge ratio becomes better by increasing the number of turns.

In an ideal TOF-MS, ions of the same mass to charge ratio start at the same starting point with the same initial energy, and arrive at the ion detector together at the same time. But in an actual TOF-MS, diversity in the initial kinetic energy of ions of the same mass to charge ratio, difference in the starting point, variation in the starting time (jitter), variation in the detection timing (jitter), fluctuation of the source voltage, etc. cause errors in the measured length of the flight time. Since these error-causing factors are unrelated to mass to charge ratio of ions, the length of flight time is not exactly the function of the mass to charge ratio, and the errors of the flight time cannot be eliminated or decreased by increasing the number of turns that the ions fly the loop orbit. This prevents improving the accuracy of the mass analysis in such type of TOF-MSs.

SUMMARY OF THE INVENTION

An object of the present invention is therefore to improve the accuracy of TOF-MSs by eliminating or decreasing errors caused by factors unrelated to the mass to charge ratio of ions.

According to the present invention, a time of flight mass spectrometer (TOF-MS) includes:

a flight space containing a loop orbit on which ions fly once or more than once;

a flight controller for making ions of a same mass to charge ratio fly the loop orbit at at least two values of number of turns;

a flight time measurer for measuring a length of flight time of the ions; and a processor for determining the mass to charge ratio of the ions based on a relationship between the value of number of turns and the length of flight time of the ions.

The "loop orbit" of the present invention may be shaped circular, like the figure "8", or in any other form of a closed line, and instead of a loop orbit, a reciprocal ion flying path may be used in the present invention.

The speed of ions flying a loop orbit depends on their mass to charge ratios. For ions of the same mass to charge ratio, the difference between the lengths of flight time of the ions flying the loop orbit N turns and of the ions flying the loop orbit N+1 turns depends on the speed of the ions, so that the difference depends on the mass to charge ratio of the ions. It should be noted here that the difference in the length of flight time is unrelated to the variation in the starting time (jitter), variation in the detection timing (jitter), etc. Thus, according to the present invention, the value of the mass to charge ratio can be precisely determined free from errors caused by such disturbing factors.

The precision in the determination of the mass to charge ratio can be enhanced by changing the value of the number of turns three times (N−1, N, N+1, for example) or more. This also improves the resolution of the mass to charge ratio of the TOF-MS, and makes the identification of ions easier.

DETAILED DESCRIPTION OF A PREFERRED EMBODIMENT

Figure 1:
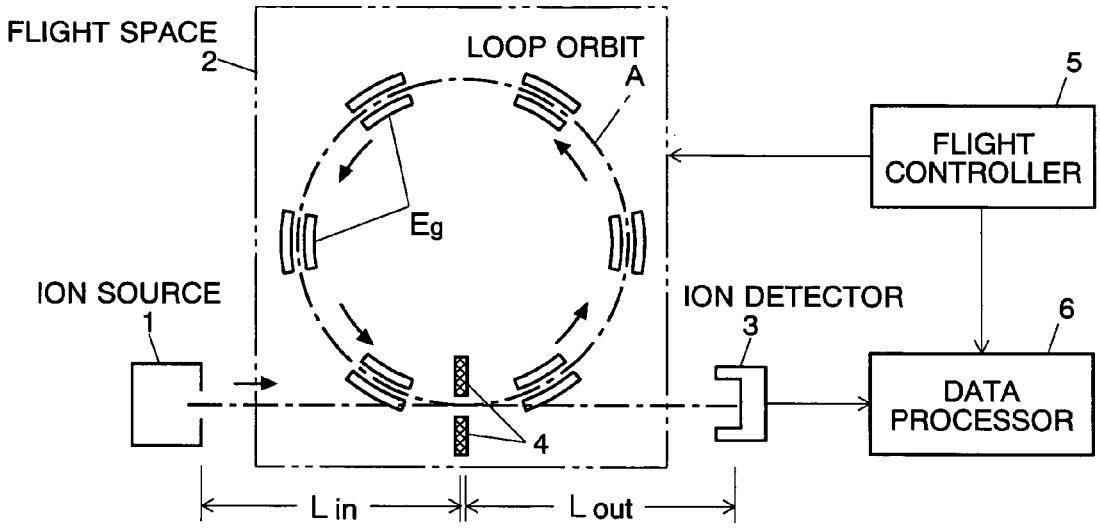
FIG. 1 is a schematic structure of a TOF-MS of an embodiment of the present invention.
Figure 3:
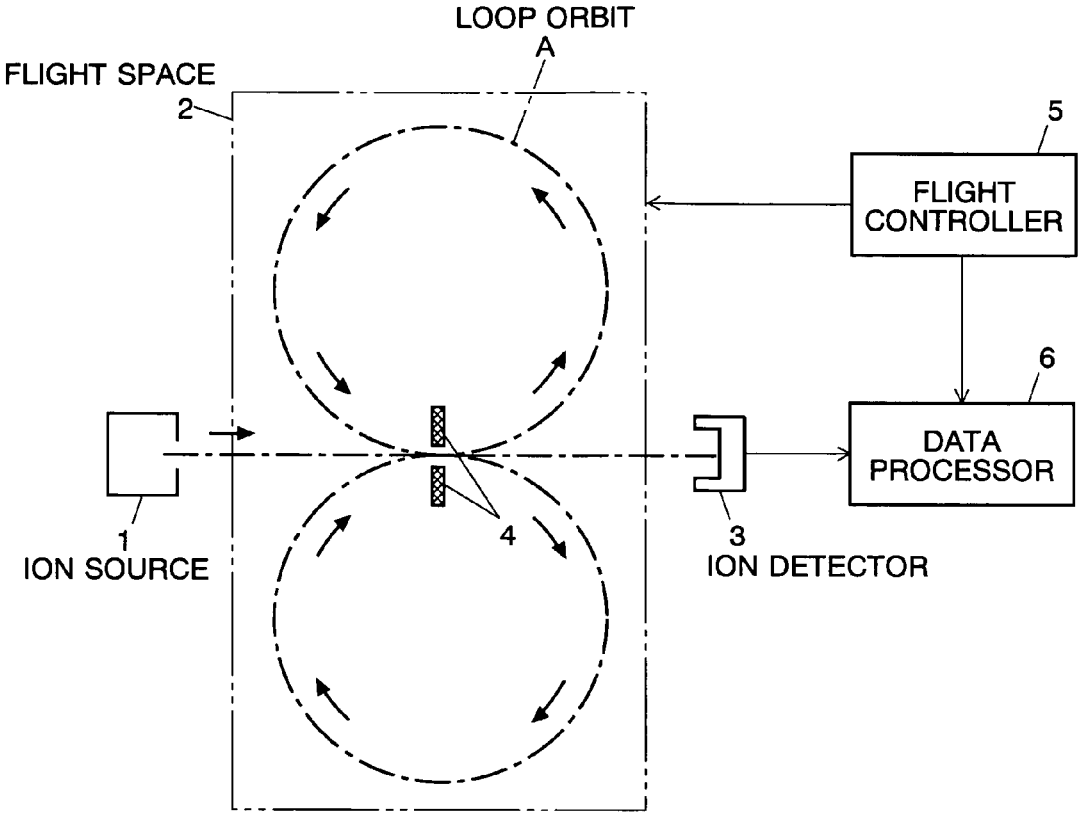
FIG. 3 is a schematic structure of a TOF-MS using a loop orbit figured "8".
Figure 4:
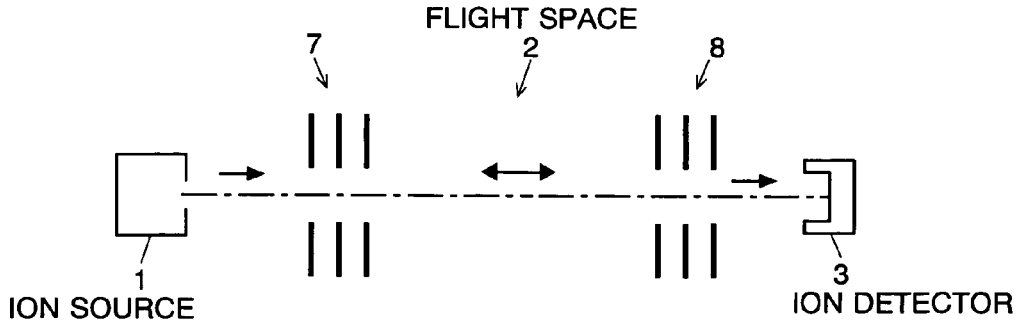
FIG. 4 is a schematic structure of a TOF-MS using a reciprocal ion flying path.

A TOF-MS embodying the present invention is described using FIG. 1. Though the TOF-MS of FIG. 1 has a circular orbit, the present invention is also applicable to an elliptic orbit, an "8" shaped orbit as shown in FIG. 3, and any other closed orbit, or loop orbit. The present invention is even applicable to TOF-MSs having a straight flight path on which ions reciprocate more than once between the entrance and the exit electrodes 7 and 8 as shown in FIG. 4.

In the TOF-MS of FIG. 1, ions starting from the ion source 1 are introduced in the flight space 2, where they are guided by the gate electrodes 4 to the loop orbit A. Ions fly the loop orbit A once or more than once, leave it, exit the flight space 2, and arrive at and are detected by the ion detector 3. The ion detection signals are sent from the ion detector 3 to the data processor 6, where various data processings are done on the digitized ion detection signals, and the mass to charge ratio of the ions are determined.

In the flight space 2, the movement of the ions flying the loop orbit A is controlled by guide electrodes Eg placed along the loop orbit A, which are applied an appropriate voltage to guide ions. The flight controller 5 supplies driving power to the electrodes in the flight space 2 including the gate electrode 4 and the guide electrodes (E1 or E2), whereby the flight controller 5 can determine the number of turns that the ions fly before they leave the loop orbit A. For the ion source 1, various conventional ion sources including an ion trap, a MALDI (Matrix-assisted Laser Desorption Ionization) type ion source, etc. can be used.

The operation of the TOF-MS of the present embodiment is described. The symbols used in FIG. 1 mean as follows:

Lin: distance from the ion source 1 to the entrance of the loop orbit A

Lout: distance from the exit of the loop orbit A to the ion detector 3

U: kinetic energy of an ion

C(U): flight length of a turn of the loop orbit A (or the circumference of the loop orbit A)

m: mass to charge ratio of an ion

TOF(m,U): length of flight time of an ion having mass to charge ratio m and kinetic energy U (length of flight time from the ion source 1 to the ion detector 3)

V(m,U): speed of an ion having mass to charge ratio m and kinetic energy U

N: number of turns an ion flies the loop orbit A

T0: error in the length of flight time caused by jitters in the measuring system and other factors From the working principle of the TOF-MS, the following equation (1) is derived.

$$TOF(m,U)=Lin/V(m,U)+N\cdot C(U)/V(m,U)+Lout/V(m,U)+T0 \quad (1)$$

When the number of turns N is changed to N', TOF1(m,U) corresponding to N changes to TOF2(m,U), as follows.

$$TOF1(m,U)=Lin/V(m,U)+N\cdot C(U)/V(m,U)+Lout/V(m,U)+T0 \quad (2)$$

$$TOF2(m,U)=Lin/V(m,U)+N'\cdot C(U)/V(m,U)+Lout/V(m,U)+T0 \quad (3)$$

The difference ΔTOF between TOF1(m,U) and TOF2(m,U) is calculated as follows.

$$\Delta TOF=TOF1(m,U)-TOF2(m,U)=(N-N')\cdot C(U)/V(m,U) \quad (4)$$

Equation (4) shows that the difference ΔTOF in the length of flight time depends on the difference in the number of turns on the loop orbit A, and does not depend on the error T0 in the flight time. It also shows that the mass to charge ratio of an ion can be precisely determined by measuring the difference ΔTOF in the length of flight time.

Figure 2:
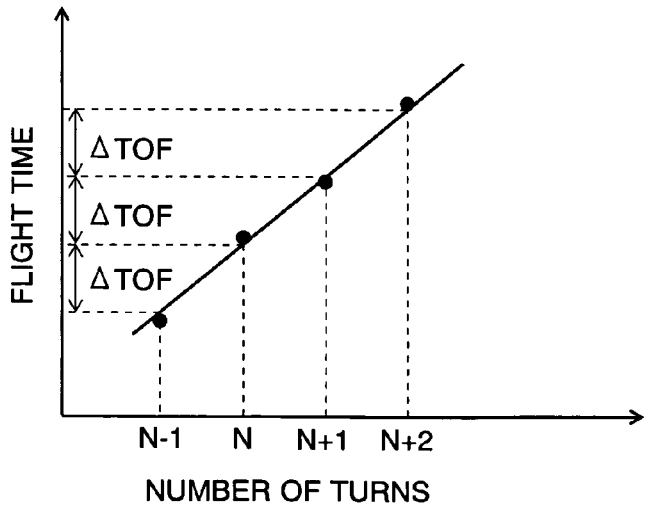
FIG. 2 is a graph showing the relationship between the value of number of turns and the length of flight time of ions.

An example of the calculation in the TOF-MS of FIG. 1 is as follows. Using the flight controller 5, the number of turns is set at four values: N−1; N; N+1; and N+2, and the length of flight time of ions of the same mass to charge ratio is measured for each value of the number of turns. The value of the number of turns and the length of the flight time have the relationship as shown in FIG. 2. Using appropriate statistical tools, the difference in the flight time for one turn can be calculated at high accuracy in the data processor 6.

The above described embodiment is a mere example, and it is obvious for those skilled in the art to modify it or add unsubstantial elements to it within the scope of the present invention.

What is claimed is:

1. A time of flight mass spectrometer (TOF-MS) comprising: a flight space containing a loop orbit on which ions fly once or more than once; a flight controller for making ions of a same mass to charge ratio fly the loop orbit at at least two values of number of turns; a flight time measurer for measuring a length of flight time of the ions; and a processor for determining the mass to charge ratio of the ions based on a relationship between the value of number of turns and the length of flight time of the ions.

2. The TOF-MS according to claim 1, wherein the loop orbit is circular.

3. The TOF-MS according to claim 1, wherein the loop orbit is figured "8".

4. The TOF-MS according to claim 1, wherein the flight controller makes ions of a same mass to charge ratio fly the loop orbit at more than two values of number of turns.

5. The TOF-MS according to claim 1, wherein the flight controller makes ions of a same mass to charge ratio fly the loop orbit at two values of number of turns, and the processor determines the mass to charge ratio of the ions based on a relationship between a difference of the two values of number of turns and a difference of the lengths of flight time of the ions at the two values of number of turns.

* * * * *